US012070113B2

(12) United States Patent
Herndon

(10) Patent No.: US 12,070,113 B2
(45) Date of Patent: Aug. 27, 2024

(54) ACCESSORY ORGANIZING SYSTEM

(71) Applicant: Mylashi Herndon, Arlington, TX (US)

(72) Inventor: Mylashi Herndon, Arlington, TX (US)

( * ) Notice: Subject to any disclaimer, the term of this patent is extended or adjusted under 35 U.S.C. 154(b) by 44 days.

(21) Appl. No.: 17/988,512

(22) Filed: Nov. 16, 2022

(65) Prior Publication Data

US 2024/0156228 A1 May 16, 2024

(51) Int. Cl.

| | |
|---|---|
| ***A45C 13/03*** | (2006.01) |
| ***A45C 15/00*** | (2006.01) |
| ***A47G 25/14*** | (2006.01) |

(52) U.S. Cl.

CPC ..... *A45C 13/03* (2013.01); *A45C 15/00* (2013.01); *A47G 25/14* (2013.01); *A45C 2200/10* (2013.01)

(58) Field of Classification Search

CPC ..... A45C 13/03; A45C 13/00; A45C 11/16; A45C 11/26; A45C 15/00; A45C 22/10

USPC ..... D32/36; D3/278, 274

See application file for complete search history.

(56) References Cited

U.S. PATENT DOCUMENTS

| | | | | |
|---|---|---|---|---|
| 5,240,120 | A * | 8/1993 | McDonough | A47F 7/02 211/85.2 |
| D367,985 | S * | 3/1996 | Hale | D6/514 |
| 5,509,588 | A | 4/1996 | Kimball | |
| 6,808,064 | B1 | 10/2004 | Fanning | |
| D637,396 | S * | 5/2011 | Berglund | D3/278 |
| D665,203 | S | 8/2012 | Carr | |
| 8,678,250 | B2 * | 3/2014 | Williams | A47G 25/20 223/71 |
| 9,215,943 | B1 * | 12/2015 | Varghese-Abraham | A47G 25/743 |
| 9,271,585 | B1 * | 3/2016 | Chung | A47F 7/021 |
| 2009/0224009 | A1 | 9/2009 | Lubow | |
| 2013/0248310 | A1 * | 9/2013 | Taylor-Phillips | A45C 13/02 190/111 |
| 2013/0313141 | A1 * | 11/2013 | Oliver | B65D 85/187 206/288 |
| 2016/0166098 | A1 | 6/2016 | Varghese-Abraham | |

FOREIGN PATENT DOCUMENTS

| | | |
|---|---|---|
| WO | WO2016109187 | 7/2016 |

* cited by examiner

*Primary Examiner* — Ismael Izaguirre

(57) ABSTRACT

An accessory organizing system for organizing accessories in a plurality of pockets hanging from a clothes hanger includes a clothes hanger and a back wall that can hang from the clothes hanger via a strap. A plurality of pockets is positioned on the back wall for containing personal accessories including jewelry.

14 Claims, 5 Drawing Sheets

ACCESSORY ORGANIZING SYSTEM

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to accessory organizers and more particularly pertains to a new accessory organizer for organizing accessories in a plurality of pockets hanging from a clothes hanger.

(2) Description of Related Art Including Information Disclosed Under 37 CFR 1.97 and 1.98

The prior art relates to accessory organizers which organize personal accessories into pockets. However, the prior art does not disclose a clothing organizing system comprising a device having multiple pockets for holding clothing accessories and a strap for allowing the attachment of the organizing device to a clothes hanger.

(h) BRIEF SUMMARY OF THE INVENTION

An embodiment of the disclosure meets the needs presented above by generally comprising a clothes hanger comprising a hook and a pair of arms attached to a lower end of the hook. A back wall has a top edge, a bottom edge, a first lateral edge, a second lateral edge, and a front surface. A strap has a pair of ends, each of which is attached to the top edge of the back wall. The strap is positionable around the hook in engagement with the hook and the pair of arms such that the back wall hangs from the clothes hanger. A plurality of pockets is positioned on the front surface of the back wall, wherein each pocket comprises a front wall is attached to the front surface such that a cavity is defined between the front wall and the back wall. The front wall also has a first edge attached to the back wall and a second edge spaced from the back wall to define an opening into the cavity.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
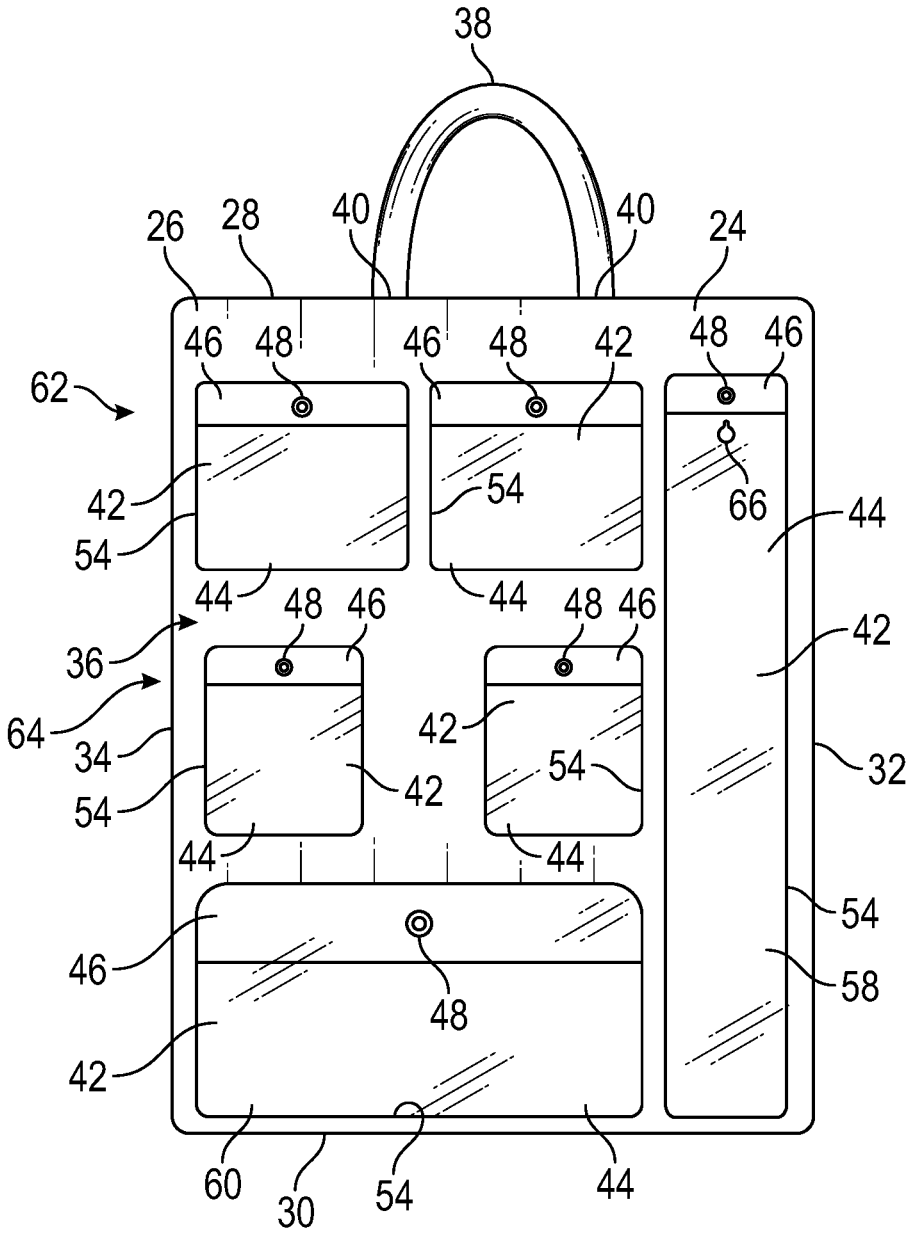
FIG. 1 is a front view of back panel of an accessory organizing system according to an embodiment of the disclosure.
Figure 2:
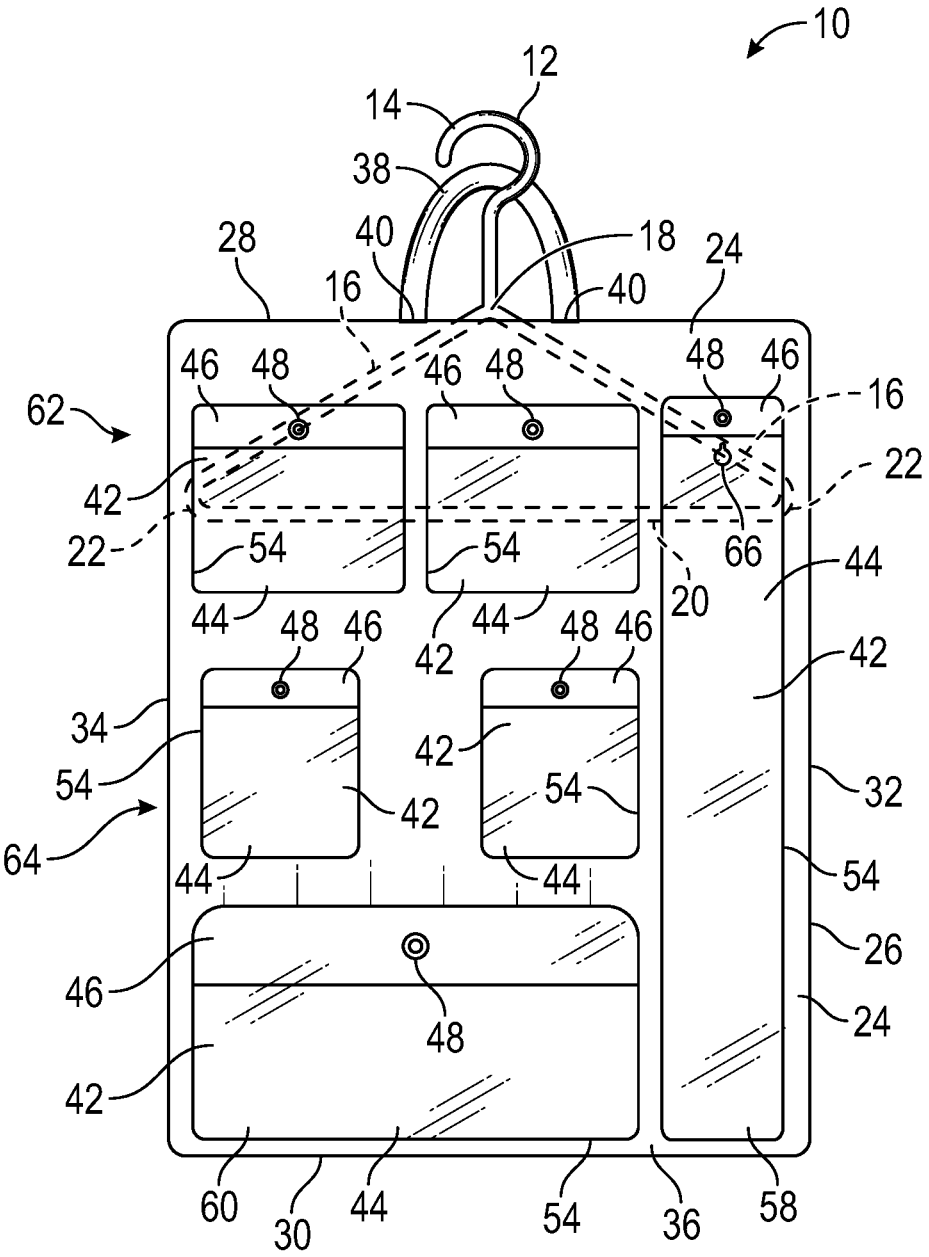
FIG. 2 is a front view of an embodiment of the disclosure.
Figure 3:
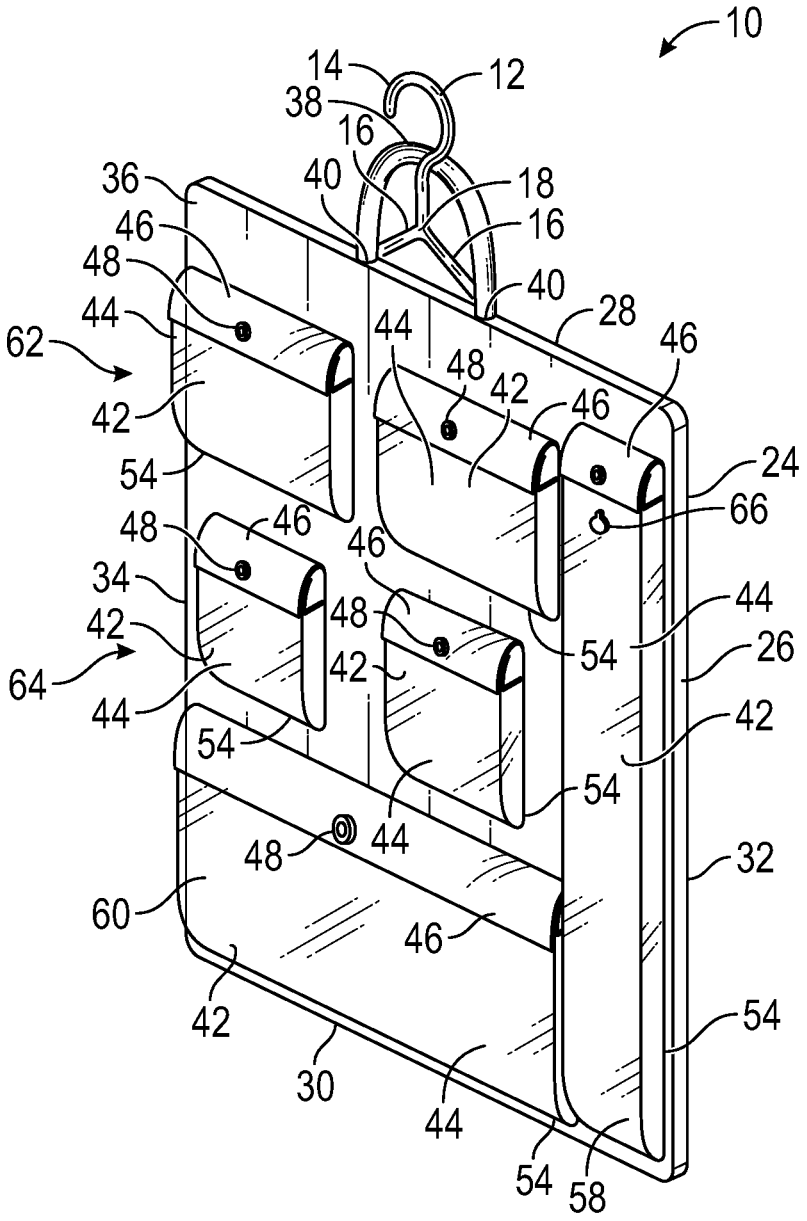
FIG. 3 is a perspective view of an embodiment of the disclosure.
Figure 4:
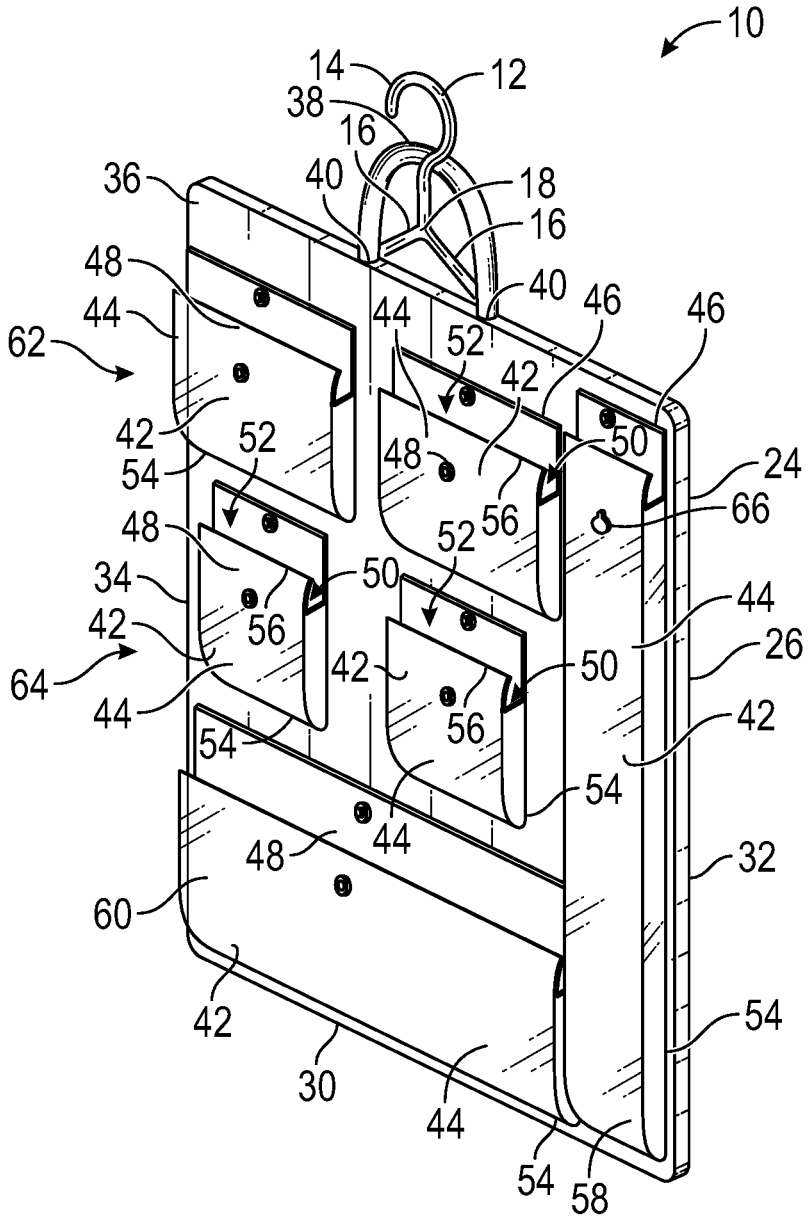
FIG. 4 is a perspective view of an embodiment of the disclosure.
Figure 5:
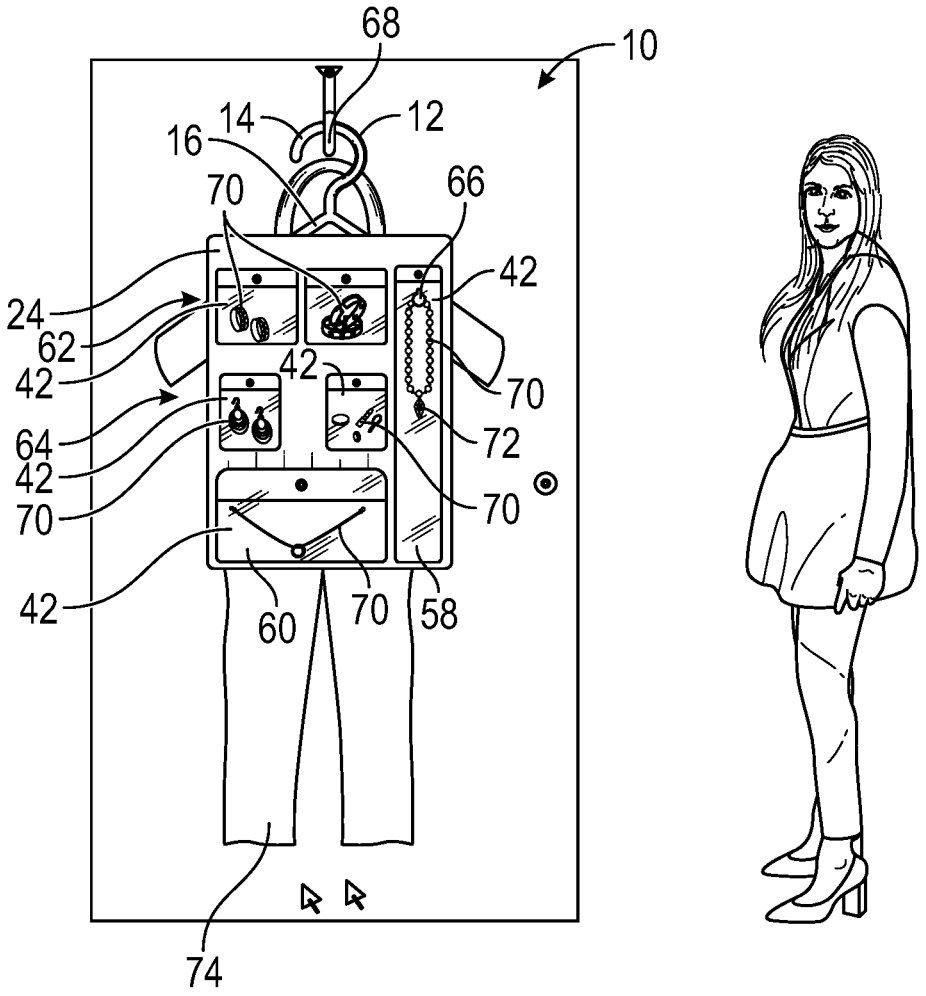
FIG. 5 is an in-use view of an embodiment of the disclosure.

With reference now to the drawings, and in particular to FIGS. 1 through 6 thereof, a new accessory organizer embodying the principles and concepts of an embodiment of the disclosure and generally designated by the reference numeral 10 will be described.

As best illustrated in FIGS. 1 through 6, the accessory organizing system 10 generally comprises a clothes hanger 12 comprising a hook 14 and a pair of arms 16 attached to a lower end 18 of the hook 14, wherein each of the pair of arms 16 extends away from each other and is angled downward. The clothes hanger 12 also has a cross member 20 extending between a distal end 22 of each of the pair of arms 16 relative to the hook 14. The clothes hanger 12 is adapted for hanging onto a rod 68 while supporting a garment 74 on the pair of arms 16.

A back wall 24 has a rectangular shape 26 and has a top edge 28, a bottom edge 30, a first lateral edge 32, a second lateral edge 34, and a front surface 36. A strap 38 has a pair of ends 40, each of which is attached to the top edge 28 of the back wall 24. The strap 38 is positionable around the hook 14 in engagement with the hook 14 and the pair of arms 16 such that the back wall 24 hangs from the clothes hanger 12.

A plurality of pockets 42 is positioned on the front surface 36 of the back wall 24, wherein each pocket 42 comprises a front wall 44, a flap 46, and a fastener 48. The front wall 44 is attached to the front surface 36 of the back wall 24 wherein a cavity 50 is defined between the front wall 44 and the back wall 24. The front wall 44 has a first edge 54 attached to the back wall 24 and a second edge 56 spaced from the back wall 24 and defining an opening 52 into the cavity 50. The opening 52 faces upward. And the front wall 44 is transparent. "Transparent" in this detailed description and in the claims describes a material having optical or structural properties which allow the contents of the pocket 42 to be seen by an individual looking through the front wall 44 of the pocket 42. The front wall 44 may thus be constructed of a clear material such as a glass or polymer with such optical properties or may be constructed of a material comprising meshed threads or the like which define a plurality of gaps that allow visible light to pass through such that the individual can see the contents of the pocket 42 through the gaps.

The flap 46 is attached to the back wall 24 adjacent to the second edge 56 of the front wall 44 and is positionable over the opening 52 to define a closed position. A fastener 48 is attached to the flap 46 to releasably secure the flap 46 in the closed position. The fastener 48 is a snap fastener comprising a male member with a lip that engages a groove of a female member of the fastener 48 when forced into an aperture of the female member under force, and which is releasable from the female member by being forced away from the female member through the aperture. The fastener 48 may instead be a hook-and-loop fastener, a button-and-hole fastener, a zipper, or the like.

The plurality of pockets 42 includes a first pocket 58 extending along the first lateral edge 32 of the back wall 24 and a second pocket 60 extending along the bottom edge 30 of the back wall 24 between the second lateral edge 34 and the first pocket 58. The plurality of pockets 42 further includes a top pair of pockets 62 positioned adjacent to the top edge 28 of the back wall 24, wherein each of the top pair of pockets 62 is laterally aligned with each other and equally sized to each other. The plurality of pockets 42 further includes a bottom pair of pockets 64 positioned between the top pair of pockets 62 and the second pocket 60, wherein each of the bottom pair of pockets 64 is laterally aligned with each other and equally sized to each other. Each of the bottom pair of pockets 64 is also smaller than each of the top pair of pockets 62.

A support 66 is mounted in the first pocket 58 and is configured to support a necklace 72 in a vertical orientation within the first pocket 58.

In use, the strap 38 is positioned around the hook 14 in engagement with the hook 14 and each of the pair of arms 16 such that the back wall 24 hangs from the clothes hanger 12. A garment 74 may also be hung from the pair of arms 16 of the clothes hanger 12. The clothes hanger 12 is then hung onto the rod 68. Accessories 70 including the necklace 72 are placed in the plurality of pockets 42 as desired and each flap 46 may be positioned in the closed position with the fastener 48 releasably securing the flap 46 to the front wall 44 of the pocket 42. The necklace 72 may be hung on the support 66 such that the necklace 72 hangs in the vertical orientation within the first pocket 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An accessory organizing system comprising:

a clothes hanger comprising a hook and a pair of arms attached to a lower end of said hook;

a back wall having a linear top edge, a bottom edge, a first lateral edge, a second lateral edge, and a front surface;

a strap having a pair of ends, each of said pair of ends being attached to said linear top edge of said back wall equidistant from a center of said linear top edge, said strap being positionable around said hook in engagement with said hook and said pair of arms such that said back wall hangs from said clothes hanger; and a plurality of pockets being positioned on said front surface of said back wall, each pocket comprising a front wall being attached to said front surface wherein a cavity is defined between said front wall and said back wall, said front wall having a first edge being attached to said back wall and a second edge being spaced from said back wall and defining an opening into said cavity.

2. The system of claim 1, further comprising each of said pair of arms extending away from each other and being angled downward, said clothes hanger having a cross member extending between a distal end of each of said pair of arms relative to said hook.

3. The system of claim 1, further comprising said back wall having a rectangular shape.

4. The system of claim 1, further comprising the opening defined by each pocket facing upward when the back wall hangs from the clothes hanger.

5. The system of claim 1, further comprising the front wall of each pocket being transparent.

6. The system of claim 1, further comprising each of said plurality of pockets further comprising a flap being attached to said back wall adjacent to said second edge of said front wall and being positionable over said opening to define a closed position.

7. The system of claim 6, further comprising each of said plurality of pockets further comprising a fastener being attached to said flap to releasably secure said flap in said closed position.

8. The system of claim 7, further comprising said fastener being a snap fastener.

9. The system of claim 1, further comprising said plurality of pockets including:

a first pocket extending along said first lateral edge of said back wall;

a second pocket extending along said bottom edge of said back wall between said second lateral edge and said first pocket;

a top pair of pockets being positioned adjacent to said linear top edge of said back wall, each of said top pair of pockets being laterally aligned with each other; and a bottom pair of pockets being positioned between said top pair of pockets and said second pocket, each of said bottom pair of pockets being laterally aligned with each other.

10. The system of claim 9, further comprising each of said top pair of pockets being equally sized to each other.

11. The system of claim 9, further comprising each of said bottom pair of pockets being equally sized to each other.

12. The system of claim 9, further comprising each of said bottom pair of pockets being smaller than each of said top pair of pockets.

13. The system of claim 1, further comprising a support being mounted in said first pocket and being configured to support a necklace in a vertical orientation within said first pocket.

14. An accessory organizing system comprising:

a clothes hanger comprising a hook and a pair of arms attached to a lower end of said hook, each of said pair of arms extending away from each other and being angled downward, said clothes hanger having a cross member extending between a distal end of each of said pair of arms relative to said hook;

a back wall having a linear top edge, a bottom edge, a first lateral edge, a second lateral edge, and a front surface, said back wall having a rectangular shape;

a strap having a pair of ends, each of said pair of ends being attached to said linear top edge of said back wall equidistant from a center of said linear top edge, said strap being positionable around said hook in engagement with said hook and said pair of arms such that said back wall hangs from said clothes hanger;

a plurality of pockets being positioned on said front surface of said back wall, each of said plurality of pockets comprising:

a front wall being attached to said front surface wherein a cavity is defined between said front wall and said back wall, said front wall having a first edge being attached to said back wall and a second edge being spaced from said back wall and defining an opening into said cavity, said opening facing upward when said back wall hangs from said clothes hanger, said front wall being transparent;

a flap being attached to said back wall adjacent to said second edge of said front wall and being positionable over said opening to define a closed position;

a fastener being attached to said flap to releasably secure said flap in said closed position, said fastener being a snap fastener;

wherein said plurality of pockets includes:

a first pocket extending along said first lateral edge of said back wall;

a second pocket extending along said bottom edge of said back wall between said second lateral edge and said first pocket;

a top pair of pockets being positioned adjacent to said linear top edge of said back wall, each of said top pair of pockets being laterally aligned with each other and equally sized to each other; and a bottom pair of pockets being positioned between said top pair of pockets and said second pocket, each of said bottom pair of pockets being laterally aligned with each other and equally sized to each other, each of said bottom pair of pockets being smaller than each of said top pair of pockets; and a support being mounted in said first pocket and being configured to support a necklace in a vertical orientation within said first pocket.

* * * * *